United States Patent [19]

Ide et al.

[11] Patent Number: 4,984,526

[45] Date of Patent: Jan. 15, 1991

[54] THREAD CHAIN GUIDING DEVICE FOR OVEREDGE SEWING MACHINES

[75] Inventors: Hiroshi Ide; Kikuo Aida; Shingo Iwae, all of Chofu, Japan

[73] Assignee: Juki Corporation, Tokyo, Japan

[21] Appl. No.: 356,574

[22] Filed: May 23, 1989

Related U.S. Application Data

[63] Continuation of Ser. No. 101,257, Sep. 25, 1987, abandoned.

[30] Foreign Application Priority Data

Sep. 30, 1986 [JP] Japan ..... 61-233596

[51] Int. Cl.[5] ..... D05B 1/20; D05B 65/00

[52] U.S. Cl. ..... 112/162; 112/199; 112/288

[58] Field of Search ..... 112/162, 197, 199, 269.1, 112/288

[56] References Cited

U.S. PATENT DOCUMENTS

| | | | |
|---|---|---|---|
| 726,310 | 4/1903 | Klemm | 112/199 |
| 2,778,329 | 1/1957 | Howell et al. | 112/199 |
| 3,489,115 | 1/1970 | Marforio | 112/288 |
| 3,867,892 | 2/1975 | Ciecior et al. | 112/288 |
| 4,777,892 | 10/1988 | Aida et al. | 112/162 |

FOREIGN PATENT DOCUMENTS

| | | | |
|---|---|---|---|
| 207468 | 2/1984 | German Democratic Rep. | 112/197 |

*Primary Examiner*—Wm. Carter Reynolds
*Attorney, Agent, or Firm*—Morgan & Finnegan

[57] ABSTRACT

A thread chain guiding device provides a needle-thread-guide plate which extends underneath a throat plate by energizing a solenoid as needed. Thus, the needle-thread-guide plate pushes the needle threads twined around a lower looper outwardly away such that the thread chain is prevented from hanging on an inner chain-off finger when it is rotated counter clockwise. The needle-thread-guide plate is retracted during a normal stitching process by de-energizing the solenoid.

3 Claims, 9 Drawing Sheets

THREAD CHAIN GUIDING DEVICE FOR OVEREDGE SEWING MACHINES

This is a continuation of co-pending application Ser. No. 07/101,257, filed on Sept. 25, 1987, now abandoned.

RELATED APPLICATIONS

This patent application contains subject matter related to that of U.S. Pat. No. 4,777,892, issued Oct. 18, 1988 and filed Jun. 23, 1986, entitled THREAD CHAIN SEWING METHOD AND DEVICE FOR TWO-NEEDLE OVERLOCK SEWING MACHINE.

BACKGROUND OF THE INVENTION

This invention relates to a two-needle overedge sewing machine and more particularly to a guiding device for a thread chain formed extending from the fabric material when an overedge sewing operation is finished.

When an overedge sewing operation performed by a conventional overedge sewing machine is finished, a thread chain is formed that extends from the fabric material. Where a two-needle overedge sewing machine is used, after each completion of the overedge sewing process, the thread chain is enfolded or back tacked between the fabric material and the looper threads to prevent the beginning or starting edge of the fabric material from fraying. Such an enfolding or back tacking process is well-known to those of skill in the art.

Referring to FIG. 7, it is a well-known practice to provide an inner chain-off finger 2 at the throat plate in a conventional overedge sewing machine to prevent the fabric material from sinking or dropping stitches by the two needles, to prevent the skipping of stitches, and to make sure the fabric has a good hand or feel.

Referring again to FIG. 7, numeral 1 denotes a throat plate and numeral 2 denotes an inner chain-off finger. Numeral 3 denotes an outer chain-off finger and numeral 4 denotes a needle entry by the right needle 11R. Numeral 5 denotes a thread chain and numeral 6 denotes a work fabric in which the thread chain is enfolded or back tacked between the work fabric 6 and the looper thread. Numeral 7 denotes a thread-chain-holding-and-cutting device which holds the thread chain and cuts it. Numeral 11L denotes a left needle.

How the thread chain is enfolded or back tacked between the fabric material and the looper thread will now be explained hereinafter. When one overedge sewing operation is finished, the presser foot (not shown) will be lifted by pedal action and the thread chain 5 is pulled in the direction of feeding to release the needle thread twining around the inner chain-off finger 2 and the outer chain-off finger 3. Then, the fabric material 6 is turned back or rotated counter clockwise to the operator's side, the thread chain 5 is inserted into the thread-chain-holding-and-cutting device 7, and the thread chain 5 is clamp-cut. New fabric material is set with the presser foot in a processing condition and the stitching starts. The thread chain is enfolded or back tacked into the seam of the new fabric material. If the thread chain 5 hangs at the inner chain-off finger 2, the thread chain is stitched by the needle, and in such a case, the thread chain would not be enfolded or back tacked.

Referring to FIG. 8A, and FIG. 8B, an application (application number 60-143591) previously filed in Japan as "Thread Chain Sewing Method and Device for Two-Needle Overlock Sewing Machine" now Japanese Patent No. 62-005387, the same applicant (Tokyo Juki Industrial Co., Ltd.) will be explained hereafter. FIG. 8A. is a front view and FIG. 8B is a plan view drawing. Numeral 10R denotes a right needle thread which is thread to the right needle 11R and numeral 10L denotes a needle thread which is threaded to the left needle 11L. Numeral 12 denotes a lower looper, numeral 13 denotes a needle thread restricting device and provides a thread restrictor **13*a* at its free end. When the thread chain which is twining around the inner chain-off finger 2 and the outer chain-off finger 3 is pulled in the direction of feeding, the restrictor 13*a* prevents the needle threads 10R, 10L from sliding in the direction of arrow "B" along the sloped arm of the lower looper 12. Thus, when the thread chain is rotated counter clockwise to the operator's side, the needle threads 10R, 10L will not hang at the inner chain-off finger 2**.

According to the above-mentioned application, longer needle thread 10 is drawn per each stitch because the restrictor **13*a* tends to push the needle thread further rightward as shown in FIG. 9B. Comparing FIG. 9B with FIG. 9A, which has no restrictor 13*a*, it is apparent that FIG. 9B draws more thread than FIG. 9A per each stroke of the lower looper. Thereby, to adjust the supply of needle thread, the standard thread take-up assembly has to be redesigned and the needle thread tension must be adjusted also. Where the stop position of the lower looper 12 is changed because the motor clutch was worn out, or any other reason, and is changed to left side slightly. Therefore, the soft chain is apt to be hung at the inner chain-off finger 2** when it is rotated counter clockwise to the operator's side.

SUMMARY OF THE INVENTION

With the foregoing in mind, it is an object of the invention to provide a new and improved thread chain guiding device which is located such that when the thread chain is rotated counter clockwise to prevent the needle thread from hanging at the inner chain-off finger and is replaced during the normal overedge sewing process such that the over-supply (over draw) of needle thread is eliminated.

According to the instant invention, the needle thread restrictor is arranged to be accessible (extendable) from the machine frame to the lower looper when the machine is stopped and the thread chain is rotated counter clockwise. Thus, the over-supply of needle thread caused by the restrictor is eliminated.

According to the instant invention, the needle threads are introduced to the left side of the outer chain-off finger or to the recess portion when the thread chain is rotated and, during the overedge sewing process, this thread chain guiding device is retracted. Thereby, the take-up assembly needs no redesigning and the needle thread tension needs no adjustment. Even if the machine is stopped in other than the standard position, the thread chain will be guided correctly to the proper position without being hung at the inner chain-off finger.

According to the instant invention, the thread chain guiding device works only when the thread chain is rotated and, during the normal overedge sewing process, the device is retracted. Thereby, without redesigning the take-up assembly and without adjusting the needle thread tension, this invention is effective to guide the thread chain without being hung at the inner chain-off finger, even in case the machine is stopped in other than the standard position.

BRIEF DESCRIPTION OF THE DRAWINGS

The accompanying drawings, referred to herein and constituting a part hereof, illustrate a preferred embodiment of the invention and, together with the description, serve to explain the principles of the invention, wherein.

DETAILED DESCRIPTION OF THE DRAWINGS

Figure 1:
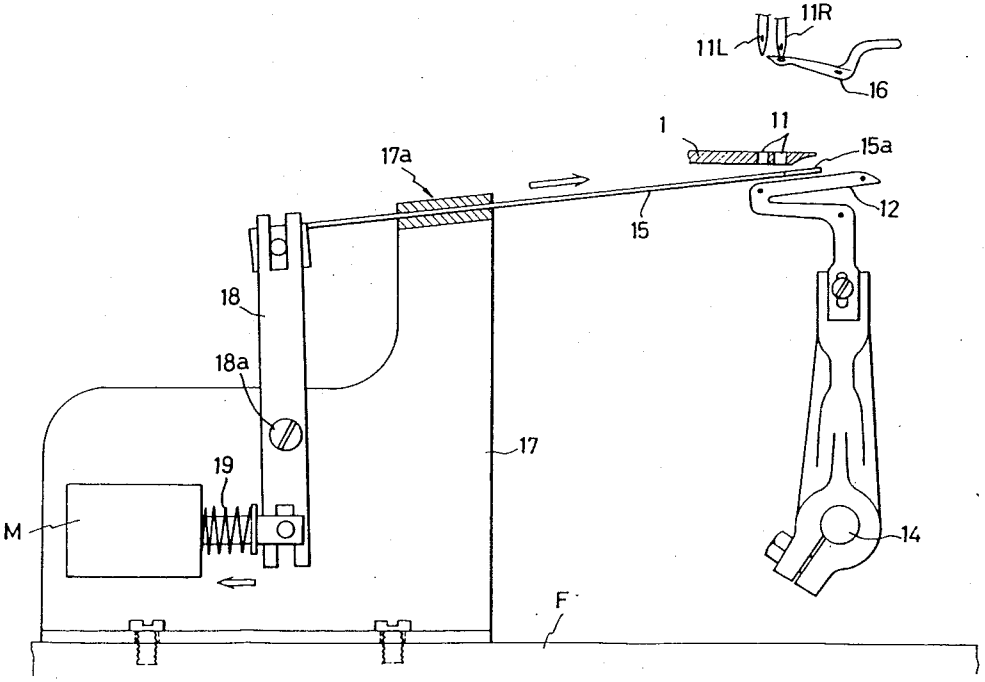
FIG. 1 is a front view drawing when illustrating the needle thread guiding device according to the instant invention is in working position.
Figure 2:
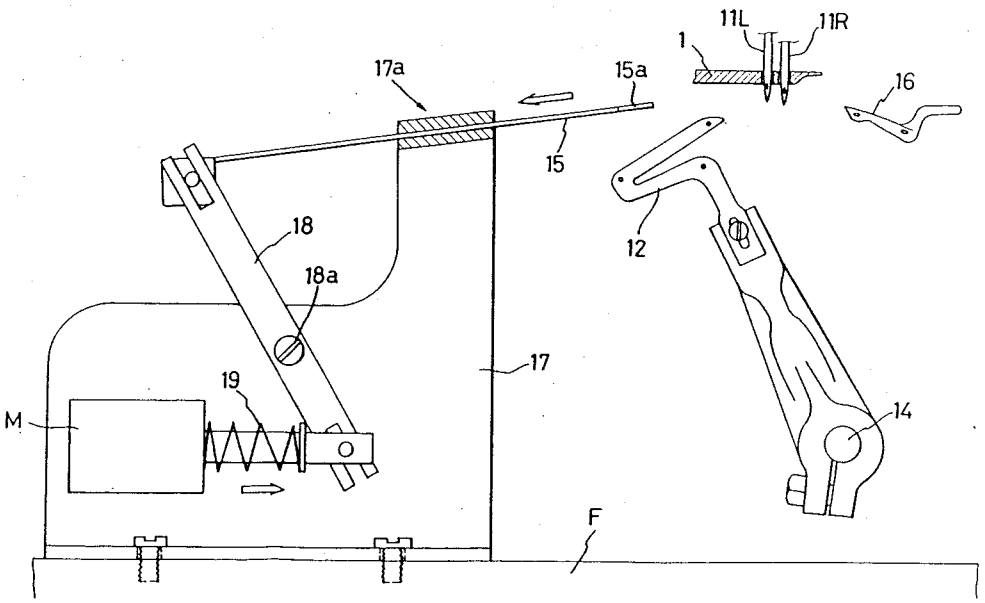
FIG. 2 is a front view drawing illustrating when the needle thread guiding device according to the instant invention is in non-working position (replaced position)

Referring to the accompanied drawings, one preferred embodiment of this invention will be explained hereinafter. FIG. 1 is a front view of one embodiment according to this invention, and FIG. 1 shows when a restrictor is in working condition. FIG. 2 is a front view of one embodiment according to this invention, and FIG. 2 shows when a restrictor is in retracted condition. Referring to FIG. 1 and FIG. 2 where the same component appears as in the previously explained FIG. 7, FIG. 8A, and FIG. 8B, the same numerals are applied.

Symbol F denotes a machine frame, numeral 14 denotes a lower looper shaft. The essential portion of this needle thread guiding device comprises a bracket 17 which is fixed to the machine frame F, a lever 18 pivoted to the machine frame F by a shaft 18*a*, a needle-thread-guide plate 15 which is slidably supported by the bifurcated end of the shaft 18 and by a guide groove 17*a* provided at the upper end of the bracket 17. The needle-thread-guide plate 15 extends to the underside of the needle entry 11 and provides a restrictor 15*a* at its tip end. The enlarged portion of the restrictor 15*a* is shown in FIG. 3 and FIG. 4.

Figure 3:
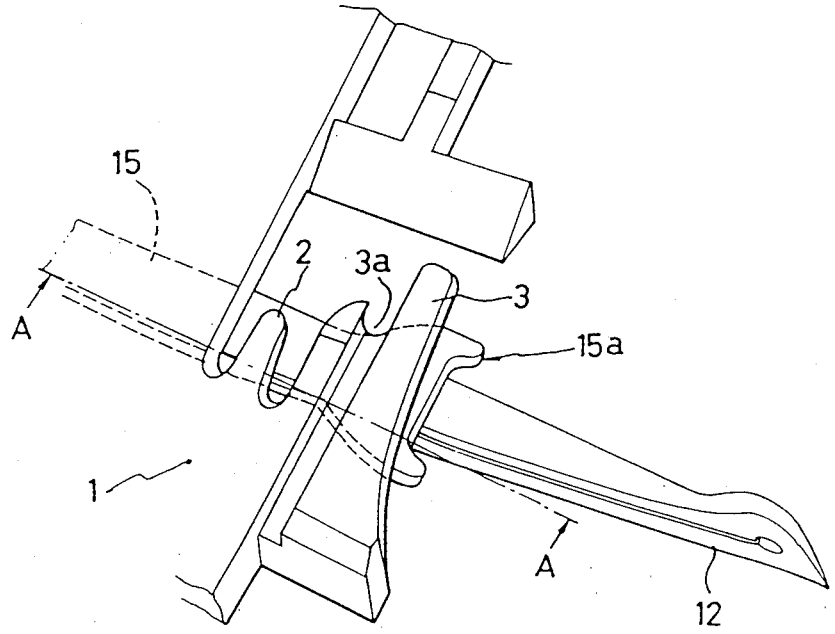
FIG. 3 is an enlarged perspective view drawing of the essential portion of a restrictor according to the instant invention.
Figure 4:
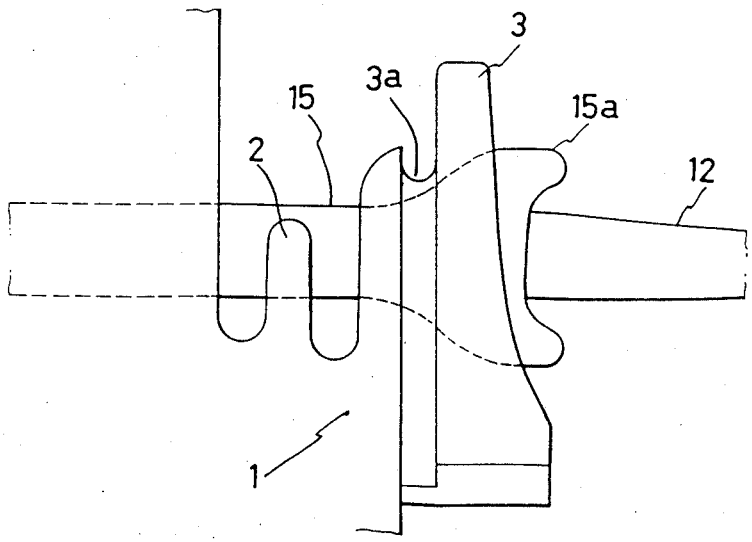
FIG. 4 is an enlarged plan view drawing of the essential portion of a restrictor according the instant invention.

FIG. 3 is a perspective view drawing and FIG. 4 is a plan view drawing. The throat plate 1 provides a recess 3*a* as shown in FIG. 3 and FIG. 4. The lower end of the lever 18 is bifurcated and is slidably connected to a plunger of a solenoid M which is fixed to the bracket 17. Normally, a spring 19 pushes the lever 18 in the direction of the arrow shown in FIG. 2 and, accordingly, the needle-thread-guide plate 15 slides in direction of the arrow in FIG. 2. The restrictor 15*a* is remotely located from the needle entry 11. When the solenoid M is energized, the plunger of the solenoid M is drawn in direction of arrow in FIG. 1 and, accordingly the needle-thread-guide plate 15 approaches the needle entry 11.

An upper looper 16 shown in FIG. 1 and FIG. 2 illustrates the positional relation with needles for each condition of FIG. 1 and FIG. 2.

Figure 5:
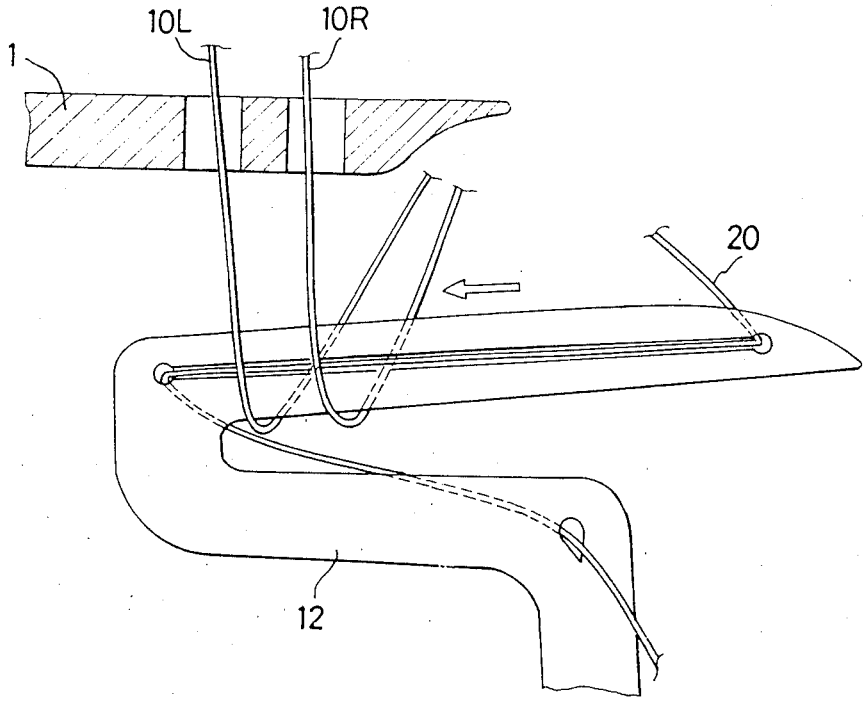
FIG. 5 Prior Art
FIG. 5 is a drawing showing how needle threads are apt to be hung at the inner chain-off finger where the instant invention is not provided.

FIG. 5 illustrates the positional relation between the lower looper 12, the lower looper thread 20, the left needle thread 10L, and the right needle thread 10R when the thread chain is ready to rotate counter clockwise but wherein this invention is not applied.

Figure 6:
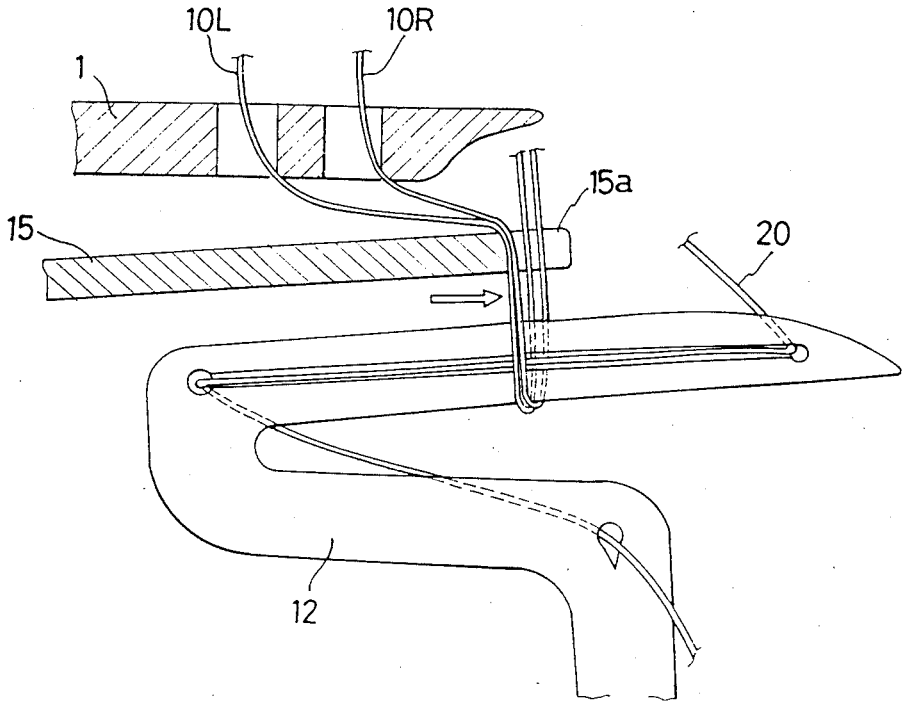
FIG. 6 is a drawing showing how needle threads are prevented from hanging at the inner chain-off finger when this invention is applied.

FIG. 6 illustrates the positional relation between the lower looper 12, the lower looper thread 20, the left needle 10L, and the right needle 10R when the thread chain is ready to rotate counter clockwise and wherein this invention is applied.

Referring to FIG. 5, both left thread 10L and right thread 10R tend to move in the direction of the arrow along the slope of the lower looper 12 when the thread chain is rotated counter clockwise. Thereby, it is anticipated the thread chain will hang at the inner chain-off finger 2 since the thread chain tends to move leftwardly beyond the groove 3*a* and approaches the underside of the needle entry. Conversely, where this invention is applied during the overedge sewing process, the solenoid M is kept de-energized by way of a pulse generator provided at the main shaft or by way of a pedal switch (pin FIGS. 1 and 2) and the needle thread guide plate 15 is retracted by the spring 19 as shown in FIG. 2.

When the sewing machine is stopped and the thread chain is ready to be rotated counter clockwise, and the workpiece detector (not shown) located adjacent to the needle hole detects no presence of the work fabric, the solenoid M is energized as shown in FIG. 1 by the pulse signal from the above-mentioned pulse generator and by the workpiece detector.

Referring to FIG. 6, as the solenoid M is energized, the needle-thread-guide plate 15 moves rightwardly and pushes both the left needle thread 10L and the right needle thread 10R. Then the thread chain is rotated counter clockwise but the thread chain will not be hung since the needle threads 10L, 10R are pushed rightwardly far enough not to be hung at the inner chain-off finger 2.

Figure 7:
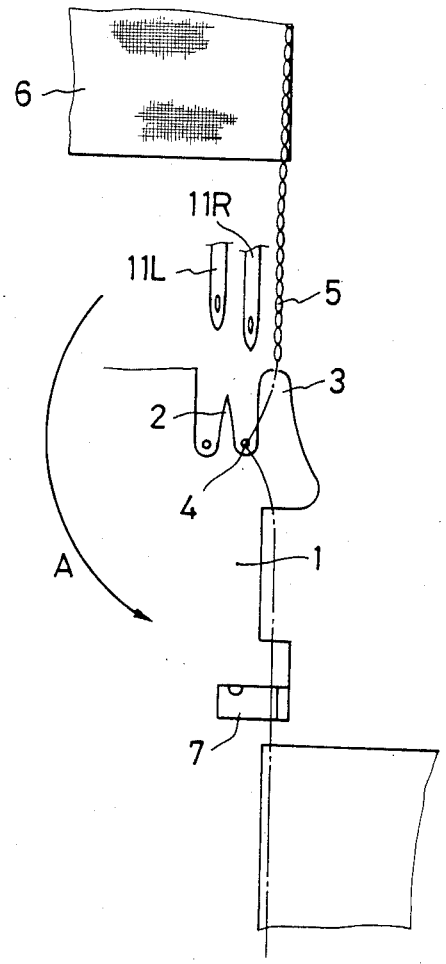
FIG. 7 Prior Art
FIG. 7 is a plan view drawing showing how a thread chain is rotated clockwise according to the prior art.
Figure 8A:
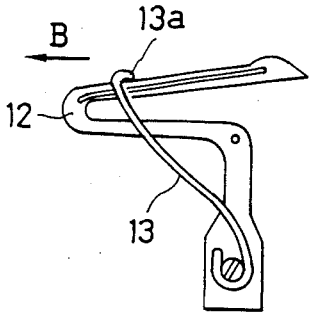
FIG. 8A Prior Art
FIG. 8A is a plan view drawing of a conventional needle thread guiding device.
Figure 8B:
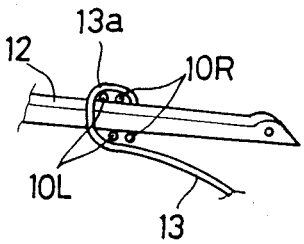
FIG. 8B Prior Art
FIG. 8B is a front view drawing of a conventional needle thread guiding device.
Figure 9A:
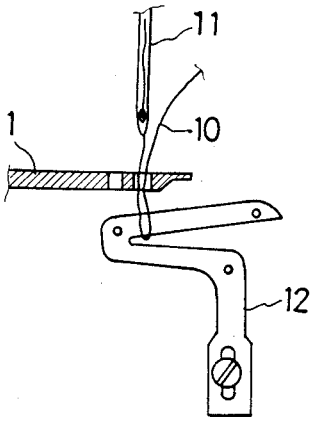
FIG. 9A Prior Art
FIG. 9A and FIG. 9B are illustrative drawings wherein FIG. 9B which has a restrictor draws much longer needle thread than 9A which has no restrictor.
Figure 9B:
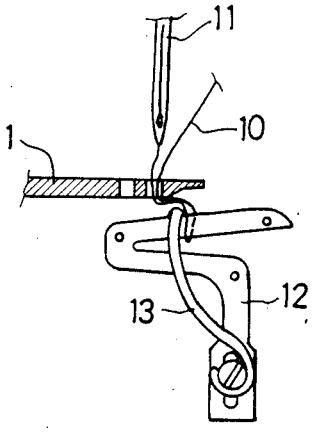
FIG. 9B Prior Art

The aforementioned explanation refers to a device equipped with a throat plate 1 having a recess 3*a* as shown in FIG. 3, but the invention is also applicable to where the throat plate 3 has no recess 3*a* as shown in FIG. 7. The shape of the restrictor 15*a* and passageway of the needle-thread-guide plate 15 should not be limited as shown in the preferred embodiment.

While the invention has been described in its preferred embodiments, it is to be understood that the words which have been used are words of description, rather than limitation, and that changes may be made within the purview of the appended claims without departing from the true scope and spirit of the invention in its broader aspects.

What is claimed:

1. A thread chain guiding device for an overedge sewing machine, comprising:

(a) a needle-thread guide extendable adjacent to a lower looper and adapted to guide the needle threads away from an inner chain-off finger;

(b) a solenoid; and (c) a pulse generator cooperatively connected to said solenoid which generates pulses in response to main shaft rotation for extending said needle-thread guide into contact with said needle thread when the sewing machine is stopped and retracting said needle-thread guide away from said needle threads when the sewing machine is operating.

2. In an overedge sewing machine having a needle plate with inner and outer chain off fingers, a thread chain guiding device comprising:

(a) a lower looper reciprocally movable about its lower end for catching needle threads to form an overedge stitch, said lower looper located under said needle plate;

(b) a needle-thread guide located under the needle plate to move between a first position where said needle-thread guide is engaged with said needle threads and a second position where said needle-thread guide is disengaged from said needle threads, said needle-thread guide adapted to transfer the needle threads to a position near to said outer chain off finger and remote from said inner chain off finger where said lower looper catches said needle threads; and (c) means for extending said needle-thread guide into engagement with said needle threads when the sewing machine is stopped and retracting said needle-thread guide away from said needle threads when the sewing machine is operating.

3. A thread chain guiding device according to claim 2, wherein said means for extending and retracting said needle-thread guide further comprises:

(a) a solenoid; and a pedal switch cooperatively connected to said solenoid which energizes the sewing machine.

* * * * *